United States Patent [19]

Pugh

[11] 4,391,503

[45] Jul. 5, 1983

[54] MAGNETIC BRUSH DEVELOPER UNIT FOR PHOTOCOPIER

[75] Inventor: Robert J. Pugh, London, England

[73] Assignee: Gestetner Manufacturing Limited, London, England

[21] Appl. No.: 247,309

[22] Filed: Mar. 25, 1981

[30] Foreign Application Priority Data

Apr. 2, 1980 [GB] United Kingdom ..... 8011042

[51] Int. Cl.[3] ..... G03G 15/09

[52] U.S. Cl. ..... 355/3 DD; 118/658

[58] Field of Search ..... 355/3 DD, 14 D; 118/657, 658; 222/DIG. 1

[56] References Cited

U.S. PATENT DOCUMENTS

| | | | |
|---|---|---|---|
| T959,003 | 6/1977 | Hull | 355/3 DD X |
| 3,472,205 | 10/1969 | Tsuchiya et al. | 118/657 X |
| 3,618,826 | 11/1971 | Kangas et al. | 222/DIG. 1 X |
| 3,631,838 | 1/1972 | Kushima et al. | 118/657 |
| 3,643,311 | 2/1972 | Knechtel et al. | 118/657 X |
| 3,863,603 | 2/1975 | Buckley et al. | 355/3 DD X |
| 3,897,749 | 8/1975 | May et al. | 118/657 X |
| 4,139,296 | 2/1979 | Ruckdeschel | 355/3 DD |
| 4,235,194 | 11/1980 | Wada et al. | 355/3 DD X |
| 4,236,485 | 12/1980 | Inukai et al. | 118/658 X |
| 4,281,918 | 8/1981 | Fortmann | 355/3 DD X |
| 4,321,886 | 3/1982 | Azuma | 355/3 DD X |

FOREIGN PATENT DOCUMENTS

| | | | |
|---|---|---|---|
| 54-43040 | 4/1979 | Japan | 355/14 D |
| 1498435 | 1/1978 | United Kingdom . | |
| 2008003 | 11/1978 | United Kingdom . | |
| 1539533 | 1/1979 | United Kingdom . | |
| 1574198 | 9/1980 | United Kingdom . | |
| 2073057 | 10/1981 | United Kingdom | 118/657 |

OTHER PUBLICATIONS

*IBM Technical Disclosure Bulletin*, vol. 18, No. 8, Jan. 1976, pp. 2413–2414; "Magnetic Brush Developer", Daniels et al.

*IBM Technical Disclosure Bulletin*, vol. 19, No. 4, Sep. 1976; pp. 1410–1411; "Magnetic Brush Developer", by K. Sanders.

*Primary Examiner*—G. Z. Rubinson

*Assistant Examiner*—Keith E. George

*Attorney, Agent, or Firm*—Fleit, Jacobson & Cohn

[57] ABSTRACT

A magnetic brush developer unit has a toner sump below the level of the magnetic brush supporting roller-shell combination and a magnetic pump rotor rotatable in the bottom of the sump to agitate toner and to return toner to a location from which it is attracted onto the shell of the magnetic brush roller. A scraper blade is effective to remove substantially all the circulating brush-forming toner from the shell and to cause at least a part of the removed toner to fall into the sump to be pumped back up by the magnetic pump rotor. An optional second scraper blade, directed in the opposite direction from that of the first scraper blade, removes any lumps of agglomerated toner which may be moving countercurrent to the main magnetic brush-forming toner mass.

9 Claims, 3 Drawing Figures

MAGNETIC BRUSH DEVELOPER UNIT FOR PHOTOCOPIER

This invention relates to developer units for electrostatic copiers. A developer unit applies toner to an electrostatic charge image previously imposed on a photoconductive member. That toner image is then transferred from the photoconductive member to copy material where the photoconductive member is a part of the copier (for example a selenium coated drum) or left on the photoconductive member where the photoconductive member is a sheet of sensitised copy paper (having a coating of, for example, zinc oxide) and then fixed to provide hard copy.

More particularly the invention is concerned with developer units of the magnetic brush type. Such a developer unit includes a magnetic brush roller having a cylindrical shell enclosing a magnetic roller, and a doctor blade which nearly touches the shell. The shell and/or the magnetic roller are rotatable by an external motor.

In use, magnetic toner is attracted to the surface of the shell by the magnetic roller. Rotation of the roller or shell or both, causes the toner to move round the shell, to form the so-called magnetic brush, the thickness of which is finely determined by the doctor blade.

The toner powder is necessarily very fine for good image resolution. A consequence of this fineness is that when the magnetic roller is rotating the toner moves round the shell in the sense opposite to that of the rotation of the inner magnetic roller. On the other hand, small lumps of toner formed by undesired agglomeration of the particles move round the shell in the same direction as the magnetic roller and are eventually held back by the doctor blade to cause peripherally extending hollows in the brush downstream of the doctoring action exerted by the doctor blade on the fine toner, to cause streaking of the toner layer of the brush and therefore of the image.

A further important problem in magnetic brush type developer units is that any toner which is not held magnetically to the shell can leak past the undersurface of the shell and thence out of the developer housing. It is urged to do so by the weight of stored toner behind it and by magnetic effects arising from the magnetic roller. These cannot be completely explained but they are observed.

Designing the housing to restrict the leakage path of the toner only encourages compression and therefore agglomeration of the toner, and that is particularly damaging when the toner is of the pressure fixing type intended to fuse when compressed.

British Patent Nos. 1539533, 1574198 and 2008003A disclose the use of a second magnetic brush transport roll which supplies developer composition to the magnetic brush developer roll proper. This additional magnetic brush establishes a steadily moving flow of developer composition towards the developer roll but relies on other mechanical parts such as mechanical "vane" pumping rotors or fixed guide vanes to control the toner composition in the shell. Such mechanical control means are unsuitable for pressure-fixing developer compositions where the mere application of mechanical pressure to the toner particles causes them to agglomerate and harden.

British Patent No. 1498435 shows an alternative solution in which toner composition is progressively released by a mechanical dispensing star wheel to be attracted onto the surface of the magnetic brush developer roll and also shows the use of an additional magnetic brush roll, serving as a cleaning roller, to remove surplus toner from the photoconductor surface and to return it to the magnetic field of the developer roll. Again, the use of a rotating mechanical metering star wheel is not acceptable for pressure-fixing toner compositions.

According to the present invention we provide a magnetic brush type of developer unit for a photocopier, comprising: a developer shell for supporting a magnetic brush of toner, in use of the developer unit; a housing defining a sump below the level of said developer shell to contain toner for forming a magnetic brush of toner on said shell, and having an aperture defining a development zone at which the magnetic brush can project from the housing into contact with a nearby photoconductor; a magnetic roller within the shell, the shell and/or the roller being drivable for rotation about a longitudinal axis; a scraper blade positioned in said housing and directed so as to remove toner from said shell after the toner has been carried past said development zone on the rotating shell; and a magnetic pump rotor positioned within the housing and having at least one magnet movable through a sump below the level of said shell, said rotor being drivable in use of the developer unit, for rotation past a concentric cylindrical sump floor portion in a direction which entrains toner received from said scraper blade to carry said toner upwardly to be applied to said shell.

In order that the present invention may more readily be understood the following description is given, merely by way of example, with reference to the accompanying drawings in which.

Figure 1:
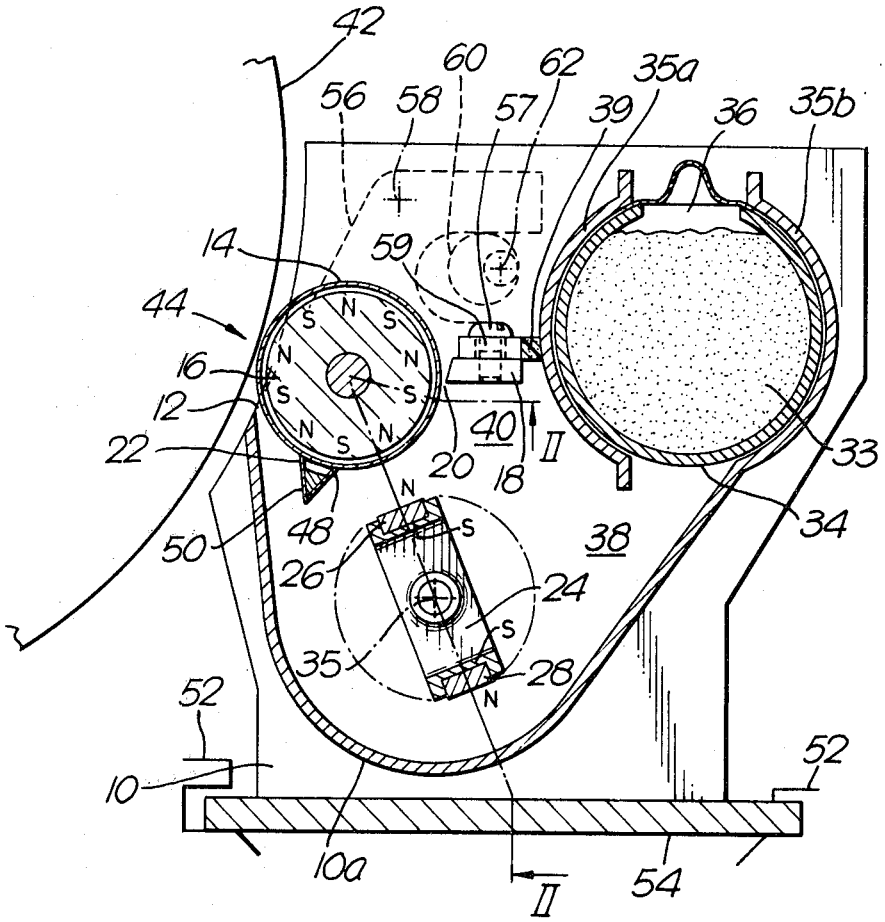
FIG. 1 shows a section taken through a developer unit embodying this invention, and incorporating many preferred features, the section being taken perpendicularly to the axes of rotation of the rotating parts.
Figure 3:
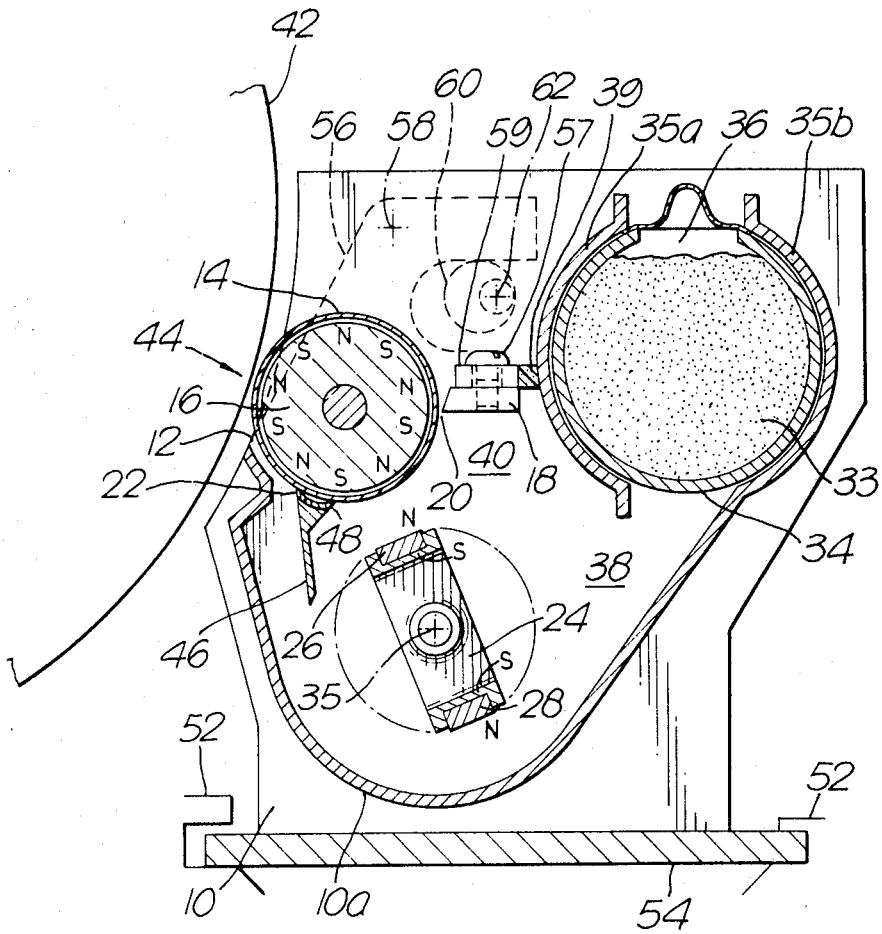

FIG. 3 corresponds to FIG. 1 but shows a modified form of developer unit in accordance with the present invention.

The developer unit comprises a housing 10 which is closed except for a transverse slot 12 in the front of the housing through which slot projects part of a rotatably driven developer shell 14 of a magnetically permeable but non magnetisable material, in this case aluminium. Within the developer shell is a rotatably mounted magnetic roller 16 which can be driven by an external motor not shown. A doctor blade 18 of a non-magnetic metal or a plastics material is mounted to the housing 10 and is adjustable laterally as viewed in FIG. 1, to maintain a narrow gap 20 between itself and the shell 14. Contacting the surface of the shell 14 is a first scraper blade 22 of plastics material.

Generally below the magnetic brush comprising roller 16 and shell 14, the housing has a trough portion **10*a* serving as a sump to which the magnetic toner is returned after having been stripped from the surface of the shell 14 by the scraper blade 22. In this sump is a magnetic pump 24 which has two magnets 26 and 28 mounted between end plates 30 and 32. The pump 24 can be rotated about an axis 35**.

The housing 10 further has a chamber 33 defined by opposed part-cylindrical walls **35*a*, 35*b*, which can accommodate a replaceable cylindrical toner canister 34**.

In use, a fresh supply canister 34 of toner, having a detachable strip covering an elongate aperture 36 along its side-wall, is inserted into the space 33; the strip is removed and the canister is then inverted by rotation through 180° so that the toner can fall into the space indicated generally as 38. A strip 39 of sponge (omitted from FIG. 2) seals a gap between the support for the doctor blade 18 and the adjacent part cylindrical wall 35*a* to prevent loss of clouds of agitated toner when the developer unit is in use.

Figure 2:
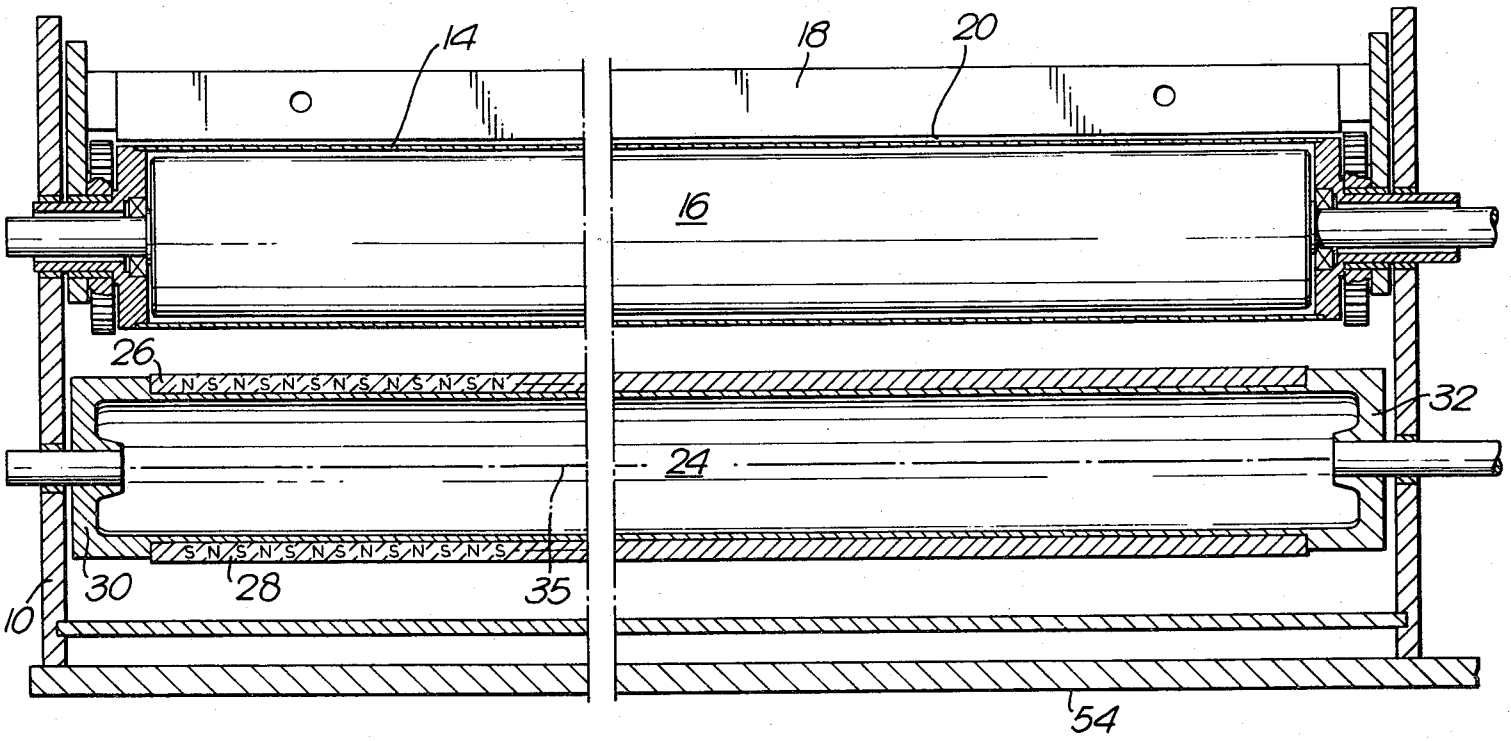
FIG. 2 is a sectional view taken on the line II—II of FIG. 1.

As shown in FIG. 2, the rotor of the magnetic pump 24 is formed of two end plates 30 and 32 between which extends two diametrically opposed bars, one of which defines the row of magnets 26, and the other of which bars defines the diametrically opposite row of magnets 28. As shown in FIG. 2, the magnets 26, 28 are arranged with radially outwardly facing surfaces along which the poles alternate between north and south so that along each of the bars there is a considerable number of north poles alternating with south poles.

Although FIG. 2 shows the directly opposite magnets 26, 28 as being of opposite polarity, it is possible for these directly opposite magnets to have identical polarity; the important characteristic is the optional feature of having several magnetic poles of alternating polarity along each of the bars of the rotor. This alternating polarity of the poles of the external surfaces alternating along each of the bars provides for maximum entrainment of toner by the magnets of both bars.

The bars may either be provided with arrays of flat magnets arranged such that the radially outwardly facing surfaces of the magnets have the required alternating polarity, or may comprise a continuous strip of magnetisable material magnetised in such a way that the direction of magnetisation alternates along the strip.

Where the bar is made up of a plurality of flat magnets arranged with the desired alternation of polarity along the external face, it may be advantageous to mount the magnets in a ferro-magnetic channel which provides a path of low magnetic resistance from the pole on the back face (i.e. on the radially inwardly facing surface) of the magnet round to the outwardly facing surface of the bar alongside the radially outwardly facing pole of opposite polarity. In this way, the magnetic effect of the radially outwardly facing pole can be enhanced and the lines of force on the radially inwardly facing side of the strip of magnets can be condensed down in order to reduce the effects of the magnetic field within the rotor of the magnetic pump 24.

The preferred form of the rotor for the magnetic pump is as shown, with a hollow interior having simply two diametrically opposed longitudinal strips sweeping the exterior of the hollow space defined by the interior of the roller. In this way, the available space for toner in the sump of the housing is increased, because toner can enter into the space radially inwardly of the bars of the magnetic pump 24.

Alternatively, the centre of the rotor of magnetic pump 24 can be filled in by a suitable solid or hollow cylindrical envelope of non-magnetic material in which the two arrays of magnets are set.

The illustrated arrangement for the magnetic pump has been found satisfactory but is not regarded as the only arrangement possible. At its most fundamental, a single dipole magnet having the shape of one of the composite linear arrays 26, 28 could be used. The magnetic poles do not have to lie in a line, but could be dispersed, or for example they could lie helically about the axis of rotation 35. There can, if desired, be more than two of the linear arrays.

A preferred feature is a second scraper blade 48 which meets the surface of the shell 14 in a direction opposed to that of the blade 22. This blade 48 acts to deflect from the surface of the shell 14 large agglomerated particles of toner which, because of their size, are carried clockwise by the rotating shell 14. So long as they stay agglomerated they remain in the space 40, orbiting repeatedly on the magnetic pump 24 and always being directed away from the gap 20 until they are broken down.

As shown in FIG. 1, the first and second scraper blades 22 and 48 are carried by a triangular beam 50 extending along the developer unit parallel to the axis of rotation of the roller 16 and shell 14, with the apex of the triangular cross section of the beam directed away from the surface of the shell 14. This particular arrangement has the advantage that finely divided toner stripped from the surface of the shell 14 by the first scraper blade 22 can pass downwardly from the scraping edge of the blade 22 and then divide into two streams, one of which falls vertically into the gap between the floor of the sump 10*a* and the cylindrical locus of the orbiting magnets 26, 28 of the magnetic pump 24, and the other part of the stream of finely divided toner can pass around the apex of the triangular beam 50 and back down the surface of the second scraper blade 48 onto the shell.

With this particular arrangement, there are then two sources of toner supplied to the shell 14 upstream of the doctor blade 18. The first source consists of the flow of toner over the apex of the beam 50 and this is a uniform build-up of toner resulting from the already uniform height of the toner brush carried by the shell 14, but the second of these sources is a pulsing supply resulting from the stirring effect of the clumps of toner extending along the lines of magnets 26 and 28. Because an excessive degree of pulsing effect in the toner supply will result in pronounced undulations on the surface of the magnetic brush carried by the shell 14, and consequently in irregularities in the density of toner applied to solid black areas of a copy, it is particularly advantageous to use the FIG. 1 arrangement where a significant proportion of the toner supply comes round the beam 50 and is of a non-pulsed form.

In operation the magnetic roller 16 and the shell 14 both rotate clockwise (as viewed in FIG. 1) but with the rotation speed of the roller 16 considerably higher than that of the shell 14. For example the shell may rotate at about 20 rpm and the roller 16 may rotate at about 1600 rpm. The magnetic pump 24 rotates anticlockwise.

Some of the toner in the space 38 becomes attracted to and held by the magnets 26 and 28. The counterclockwise movement of the magnets 26 and 28 about the axis 35 acts to keep the toner agitated both in the space 38 and further upwards in a space 40, where some of it is attracted to and held by the magnetic roller 16 and caused to move anticlockwise around the surface of the shell 14. The toner on the rotating shell 14 is formed into a uniform layer, whose thickness is determined by the position of the doctor blade 18. The toner layer on the shell 14 just contacts the surface of a photoconductor drum 42 at a zone 44, referred to herein as the development zone. Toner which does not pass to the electrostatic charge image on the photoconductor drum in the developer zone remains on the shell 14 until it meets the first scraper blade 22 which deflects all anticlockwise-moving toner from the shell causing some of it to fall under gravity, whereafter it is carried anticlockwise by the magnets 26 or 28 to pass again into the spaces 38 and 40, the rest of the toner, namely that which stays under the effect of the roller magnets, sliding over the first scraper blade 22, the apex of the triangular beam 50 and the second scraper blade 48.

This movement of the toner upwardly out of the trough-shaped sump 10*a* of the housing 10 is achieved by virtue of the magnetic attraction of the toner powder by the magnets 26, 28 of the pump rotor giving rise to a sweeping action of a clump of loosely held, magnetically attracted toner rearwardly and upwardly along the floor of the trough thereby sweeping ahead of it toner powder already deposited on the inclined rear part of the floor of the housing 10.

The toner powder is of the pressure-fusing type and would therefore be likely to agglomerate if subjected to too much pressure during a sweeping action. For that reason, it is particularly advantageous to use magnetic attraction of the clump of toner powder on the respective arrays of magnets 26, 28 of the magnetic pump 24 since this gives a limited holding action.

FIG. 3 shows an alternative arrangement in which a second doctor blade 46, extending downwardly from the triangular beam 50 supporting the first and second scraper blades 22 and 48, prevents any of the toner scraped off by the blade 22 from passing straight back onto the shell 14 without passing via the sump 10*a* and pump 24. This second doctor blade 46 also serves to limit the radial height of the clumps of toner carried by the magnets 26 28 of the magnetic brush 24. This has the advantage of ensuring that there will be sufficient capacity on the magnetic pump for entraining toner which has just been delivered by the first scraper blade 22, such that this entrained toner can then be pumped rearwardly and upwardly by the rotation of the magnetic pump 24 without risk of compression of the toner which is entrained by the pump. Naturally, if the height of toner on the magnets 26, 28 is too great, then the effect of combining the newly entrained toner from the first scraper blade 22 with the already entrained toner on the pump magnets 26, 28 will give rise to a tendency to crush toner into the gap between the pump 24 and the floor of the sump.

Because, in the FIG. 1 embodiment, part of the flow of toner can pass over the apex of the triangular beam 50, and back onto the shell 14 without being entrained by the magnetic pump 24, the tendency for compression of the toner in the gap between the rotor of the pump 24 and the floor of the sump 10*a* is further reduced. However, it may nevertheless be desirable to incorporate some means for limiting the height of toner clumps on the magnets 26, 28 and this can be achieved by any suitably positioned limiting member, for example a bar extending along the developer unit substantially coincident with the doctoring edge of the blade 46 shown in FIG. 3.

The developer units illustrated in FIGS. 1 and 3 are intended to be withdrawn from alongside the photoconductor drum 42, by movement axially of the drum, and this is achieved by means of guides 52 into which the flat base 54 of the developer unit can slide. Means (not shown) may be provided to urge the developer unit forwardly (i.e. leftwardly) once it is in its correct axial position, in order to bring the housing 10 into the desired positioning with respect to the photoconductor drum 42, and hence to bring the forward (i.e. lefthand) edge of the base 54 (as viewed in FIG. 1) into engagement with the floor of the groove formed in the forward or lefthand support 52.

The magnetic brush roller defined by the shell 14 and the internal magnetic roller 16 is intended to be carefully spaced from the surface of the drum 42, by means of rolling wheels (FIG. 2) at each end of the shell to engage the surface of the photoconductor drum. In order to achieve this engagement, the ends of the brush roller assembly 14, 16 are independently suspended with respect to associated carrier frames 56 and the carrier frames 56 are themselves pivoted for movement about an axis 58 under the influence of an eccentric 60 which is rotatable about its pivot shaft 62 to effect pivoting of the carriers 56 to bring the magnetic brush roller assembly 14, 16 into and out of engagement with the drum 42. The carrier frames 56 are biased clockwise about the axis 58 by a tension spring (not shown).

Naturally, for axial withdrawal of the developer unit it is necessary for the magnetic brush roller assembly 14, 16 to be withdrawn from contact with the drum 42, otherwise there is a risk of scraping the fragile and valuable selenium surface on the drum 42.

The front part of the floor of the sump trough 10*a* of the housing 10 has a deliberately steeply inclined wall in order to ensure that no toner can rest on the floor of the sump trough 10*a* upstream of the region swept by the pump rotor and consequently all the toner which falls from the magnetic brush roller shell 14 is either divided into a first stream returning to the shell and a second stream all of which comes under the influence of the pump 24 (i.e. in the FIG. 1 embodiment) or is totally deflected into the cylindrical zone of influence of the magnetic pump 24 (in the FIG. 3 embodiment).

It is the intention that no toner can stagnate anywhere in the developer unit and that consequently thorough agitation of the toner will be maintained.

It is known that different types of single component toner have different flow properties, i.e. different angles of repose, and it has been found that the developer unit in accordance with the present invention can handle toners having values over a very wide range of flow properties.

As indicated above, in the type of magnetic brush developer seen in the drawing, the shell 14 and the magnetic roller 16 within it rotate in the same direction and the magnetic roller 16 rotates much faster than the shell 14. Such a type of roller assembly 14,16 gives good development because the toner is only lightly held to the shell and is agitated within the layer on a macromolecular scale. This system is particularly useful for pressure-fixing toners in which such loose agitation is beneficial.

The principles of this invention can be used to advantage in the known alternative arrangements, in which for example the magnetic roller rotates but the shell remains stationary, or in which the magnetic roller turns counter to the shell, or where the magnet is stationary but the shell rotates. The relative advantages and disadvantages of their different systems and the relative properties of different toners, are known in the art. The principles of the present invention can be applied to any of them with differing degrees of advantage. The magnetic pump acts to deflect toner away from the slot 12 and thus to prevent undesirable loss of toner from the slot giving rises to contamination of the copier and of the copies. Moreover the space provided in the sump 10*a* of the housing 10 to accommodate the magnetic pump, is clearly sufficient to accommodate all the toner from a full canister 34, hence no toner within the housing will reach the slot 12 merely under the action of gravity.

A bias, either ac, dc, or earth potential can be applied to the developer shell 14.

The clearance between the cylindrical floor of the trough 10*a* of the housing 10 and the path swept by the radially outer surfaces of the magnets 26 and 28 of the rotor of the magnetic pump 24 is carefully related to the strength of the magnets 26 and 28.

Allowing for any initial loss of magnetic strength due to aging of the magnets, the desired configuration is such that toner lying on the cylindrical floor portion of the trough 10*a* is only just within the magnetic field of the passing magnets 26 or 28 and consequently will just about be entrained by the passing clamp of toner loosely held by the rotor magnets. This ensures that the desired sweeping action of the toner in the floor of the trough rearwardly and upwardly towards the space 38 and then onto the space 40 within the housing can be achieved such that no toner stagnates on the inner surface of the cylindrical floor of the trough and yet at the same time there is no undesirable compression of the toner in the space between the passing magnets 26, 28 and the trough floor to an extent which would be likely to give rise to pressure-fusing of the toner and undesirable permanent agglomeration on the trough wall or the magnets 26, 28. The stronger the magnets 26 and 28, the greater can be the radial spacing between the axis 35 of the rotor 24 and the radially inwardly facing surface of the floor of the trough 10*a*.

The existence of a smoothly arcuate cylindrical floor to the trough enhances the sweeping action on the toner without giving rise to a danger of harmful agglomeration and fusing due to the effects of the packing together of the toner. The agitation of the toner in the space 38 downstream of the magnetic pump 24 is widespread but is caused by a yieldable agitator (the clump of magnetically attracted toner on the passing magnets 26, 28) and consequently there is no danger of undesirable packing of the toner.

As indicated above, the agitation of the toner in the chamber 38, and also further over in the space 40 just below the doctor blade 18, is such that the application of toner to the shell 14 is to some extent pulsed, causing ripples extending parallel to generatrices of the shell 14. This rippling effect can to some extent be attenuated by suitable adjustment of the doctor blade 18, although in fact the positioning of the blade 18 is intended to control the mean thickness of the brush of toner on the shell 14. This adjustment of the position of the doctor blade 18 requires simply slackening off the screws 57 and then, bearing in mind that the screws are a very loose fit in a clearance hole in the carrier 59, moving the doctor blade so as to leave, between the doctoring edge and the surface of the shell 14, a uniform gap of the desired thickness.

Although the apparatus illustrated in FIGS. 1 to 3 is of the plain paper type, where the drum 42 is formed of electrically conducting material having a surface coating of photo-conductive selenium thereon, the developer unit will work equally well with the so-called sensitised paper type of copier where the photo-conductive material is a zinc oxide-coated sheet of paper on which the electrostatic image is itself formed and then developed and fused without transfer.

The use of a magnetic pump comprising magnets physically moving through the mass of toner composition in the housing provides a surprisingly effective means of holding toner against inadvertent escape through the development slot of the housing, without causing toner agglomeration in the case of a pressure fixing toner composition.

The magnetic brush type of controlling means used in the prior art, while having the advantage of providing a relatively steady flow of toner to the magnetic brush developer roll (as compared with the pulsing action derived from the use of discrete magnets 26 and 28 in the magnetic pump rotor of the present application) is only able to handle a limited flow of toner and the additional mechanical control means are necessary, with the concomitant risk of the mechanically applied pressure causing toner agglomeration and hardening. By contrast, the magnets of the pump in accordance with the present invention are continually rotating in a cylindrical space within the mass of toner but achieve their "pumping action" by the rotation (outside that cylindrical space) of the sweeping magnetic "tufts" formed by the circulating clumps of toner composition attracted to the magnets outside the swept volume. In this arrangement the magnets in the cylindrical space are not expected to impact toner in that swept space, and the fact that the "tufts" are yieldable avoids the application of excessive mechanical pressure which might result in agglomeration and hardening of the toner. The yieldable "tufts" are however able to exert a significant pumping action which, although pulsatory, is readily capable of being smoothed during application of the toner to the shell 14 of the magnetic brush developer roll.

I claim:

1. In a magnetic brush developer unit for a photocopier, comprising:

(a) a developer shell for supporting a magnetic brush of single component toner in use of the developer unit;

(b) a housing defining a sump below the level of said developer shell to contain toner for forming a magnetic brush of toner on said shell;

(c) aperture means to said housing defining a development zone at which the magnetic brush can project from the housing;

(d) a magnetic roller within the developer shell, setting up a magnetic field around the developer shell;

(e) means operable to drive at least one of the developer shell and the roller for rotation about a longitudinal axis;

(f) a scraper blade positioned in said housing and directed so as to remove toner from said developer shell after the toner has been carried past said development zone on the developer shell;

(g) a rotatable magnetic member positioned within the housing below the level of said developer shell; and (h) means for driving said rotatable magnetic member in use of the developer unit, for rotation to entrain toner received from said scraper blade; the improvement wherein:

(i) said rotatable magnetic member includes magnet means for magnetically attracting and holding toner on a surface of said rotatable magnetic member so that a clump of loosely held toner is formed on the surface of said magnetic member, the clump being movable through said sump along a circular path in contact with the toner in said sump, to carry said toner upwardly to join a stream of toner being applied to said developer shell, said toner being conveyed to a location wherein the magnetic field around said developer shell magnetically attracts toner from exterior portions of the clump, thereby avoiding mechanical agitation and coagulation of said toner.

2. A developer unit according to claim 1, wherein:

(a) said housing is an elongate trough with a part-cylindrical floor portion based on a longitudinal axis;

(b) said rotatable magnetic member has an axis of rotation coincident with said longitudinal axis of said part-cylindrical trough-shaped floor; and said trough having first and second side walls and said developer shell being positioned along said first side wall of said trough, said first side wall being steeper than said second side wall.

3. A developer unit according to claim 2, and including means defining a toner charging opening along said trough above said second side wall thereof, and a cylindrical recess to receive a toner canister, and wherein said toner charging opening comprises a longitudinal slot formed along said recess and at a level higher than said rotatable magnetic member.

4. A developer unit according to claim 1, 2, or 3, and including a control member positioned adjacent the path of said rotatable magnetic member to limit the radial height of clumps of toner carried by said magnetic means thereof during rotation of the rotatable magnetic member in use of the apparatus.

5. A developer unit according to claim 1, 2 or 3 wherein said rotatable magnetic member comprises end plates joined by said magnet means, said magnet means having an axis spaced from the axis of rotation of said rotatable magnetic member.

6. A developer unit according to claim 5, wherein said magnet means comprise two magnets joining said end plates.

7. A developer unit according to claim 5, wherein said magnet means comprises at least one member extending between the end plates and including a plurality of magnetic poles disposed therealong.

8. A developer unit according to claim 5, wherein said rotatable magnetic member has an open centre defining a notional cylindrical surface swept by said magnet means.

9. A developer unit according to claim 1, 2 or 3, wherein the only moving parts in said developer unit are said magnetic roller, said developer shell and said rotatable magnetic member.

* * * * *